US009505578B2

(12) United States Patent
Noso

(10) Patent No.: US 9,505,578 B2
(45) Date of Patent: Nov. 29, 2016

(54) SHEET CONVEYING DEVICE AND IMAGE FORMING APPARATUS INCLUDING THE SAME

(71) Applicant: KYOCERA Document Solutions Inc., Osaka-shi, Osaka (JP)

(72) Inventor: Terumitsu Noso, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/498,683

(22) Filed: Sep. 26, 2014

(65) Prior Publication Data

US 2015/0091235 A1 Apr. 2, 2015

(30) Foreign Application Priority Data

Sep. 30, 2013 (JP) ..... 2013-203541

(51) Int. Cl.

| | |
|---|---|
| ***B65H 31/00*** | (2006.01) |
| ***B65H 29/70*** | (2006.01) |
| ***B65H 5/06*** | (2006.01) |
| ***B65H 5/36*** | (2006.01) |
| ***B65H 29/14*** | (2006.01) |

(Continued)

(52) U.S. Cl.

CPC ..... *B65H 29/70* (2013.01); *B65H 5/068* (2013.01); *B65H 5/36* (2013.01); *B65H 29/14* (2013.01); *B65H 29/52* (2013.01); *G03G 15/6573* (2013.01); *B65H 2301/4212* (2013.01); *B65H 2301/51214* (2013.01); *B65H 2404/1521* (2013.01); *B65H 2404/61* (2013.01); *B65H 2801/06* (2013.01)

(58) Field of Classification Search

CPC ..... B65H 2301/4223; B65H 29/52
USPC ..... 271/207, 209, 220–223
See application file for complete search history.

(56) References Cited

U.S. PATENT DOCUMENTS

| | | | | |
|---|---|---|---|---|
| 5,194,904 | A * | 3/1993 | Ruch | 399/397 |
| 6,986,574 | B2 * | 1/2006 | Nojima | B41J 13/106 271/314 |

(Continued)

FOREIGN PATENT DOCUMENTS

| | | | |
|---|---|---|---|
| JP | 01267252 | A | 10/1989 |
| JP | 10-338407 | * | 12/1998 |
| JP | 2005263418 | A | 9/2005 |

(Continued)

OTHER PUBLICATIONS

Machine translation of Detailed Description section of Japanese Publication No. 2011-68445.*

*Primary Examiner* — Thomas Morrison
(74) *Attorney, Agent, or Firm* — Alleman Hall McCoy Russell & Tuttle LLP

(57) ABSTRACT

A sheet conveying device is provided in a paper sheet discharge portion of an image forming apparatus. The sheet conveying device includes, inside thereof, a pair of conveyance guides forming a curved path. A stiffening member is attached to an upper conveyance guide. The stiffening member includes a first pressing portion on the downstream side in the conveyance direction, and a guide portion on the upstream side. The first pressing portion is positioned at a lower position than a nip portion of a pair of discharge rollers. The guide portion is positioned at an upper position than the nip portion. The guide portion is narrower in the width direction than the first pressing portion.

7 Claims, 11 Drawing Sheets

(51) Int. Cl.
*B65H 29/52* (2006.01)
*G03G 15/00* (2006.01)

(56) References Cited

U.S. PATENT DOCUMENTS

| | | | | |
|---|---|---|---|---|
| 2012/0112402 | A1* | 5/2012 | Onishi | 271/109 |
| 2012/0313318 | A1* | 12/2012 | Ishikuro | 271/225 |

FOREIGN PATENT DOCUMENTS

| | | | | |
|---|---|---|---|---|
| JP | 2006062855 | A | | 3/2006 |
| JP | 2008189393 | A | | 8/2008 |
| JP | 2011-68445 | | * | 4/2011 |
| JP | 2011173720 | A | | 9/2011 |
| JP | 5265599 | B2 | | 8/2013 |

* cited by examiner

SHEET CONVEYING DEVICE AND IMAGE FORMING APPARATUS INCLUDING THE SAME

INCORPORATION BY REFERENCE

This application is based upon and claims the benefit of priority from the corresponding Japanese Patent Application No. 2013-203541 filed on Sep. 30, 2013, the entire contents of which are incorporated herein by reference.

BACKGROUND

The present disclosure relates to a sheet conveying device for conveying a sheet member, in particular to a sheet conveying device for stiffening a sheet member and discharging it from a sheet discharge outlet, and to an image forming apparatus including the sheet conveying device.

Conventionally, a conventional image forming apparatus such as a copier, a printer or the like includes a stiffening member that stiffens a print sheet (sheet member) on which an image has been formed, before the print sheet is discharged. The stiffness of a print sheet represents a resistance against a force applied to the print sheet in a bending direction, and is also referred to as "rigidity". When a print sheet is discharged while nipped by a pair of discharge rollers, a conventional, typical stiffening member curves the print sheet by pressing the print sheet in an upper or lower direction than the nip portion of the pair of discharge rollers. This is performed in order to give the print sheet a high stiffness. With such a stiffening member, the print sheet is prevented from hanging down immediately after the discharge. That is, the stiffened print sheet hangs down at a farther position from the discharge outlet than not-stiffened print sheets and then contacts print sheets stacked on the sheet discharge tray. As a result, the contact area between the discharged print sheet and the print sheets on the sheet discharge tray becomes narrower, the contact time becomes shorter, and the pressing force at the contact becomes smaller. Accordingly, this prevents the stack state or stack order of the print sheets stacked on the sheet discharge tray from being disturbed.

SUMMARY

A sheet conveying device according to an aspect of the present disclosure includes a first conveyance guide member and a second conveyance guide member, a first discharge roller and a second discharge roller, and at least one first stiffening member. The first conveyance guide member and the second conveyance guide member are disposed to face each other and form a discharge path extending to a sheet discharge outlet. The first discharge roller and the second discharge roller are disposed to face each other across the discharge path and configured to nip a sheet member conveyed in the discharge path and discharge the sheet member from the sheet discharge outlet to outside, wherein the first discharge roller is provided in the first conveyance guide member, and the second discharge roller is provided in the second conveyance guide member. The at least one first stiffening member projects toward the discharge path from one of the first conveyance guide member and the second conveyance guide member and extends from a nip portion to an upstream side in a sheet conveyance direction, and configured to stiffen the sheet member by contacting and pressing the sheet member conveyed in the discharge path, wherein the nip portion is formed by the first discharge roller and the second discharge roller. Each of the at least one first stiffening member includes a first pressing portion and a guide portion. The first pressing portion is provided in a facing surface that faces the sheet member, and arranged at a position that corresponds to the nip portion when viewed from one side in width direction of the discharge path that is a direction perpendicular to the sheet conveyance direction. The first pressing portion projects farther toward the other of the first conveyance guide member and the second conveyance guide member than the nip portion. The guide portion is provided in the facing surface, and arranged at a position more on the upstream side in the sheet conveyance direction than the first pressing portion. The guide portion is configured to guide, toward the first pressing portion, a front end of the sheet member conveyed in the discharge path. The guide portion is narrower in the width direction than the first pressing portion.

An image forming apparatus according to another aspect of the present disclosure includes the above-described sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
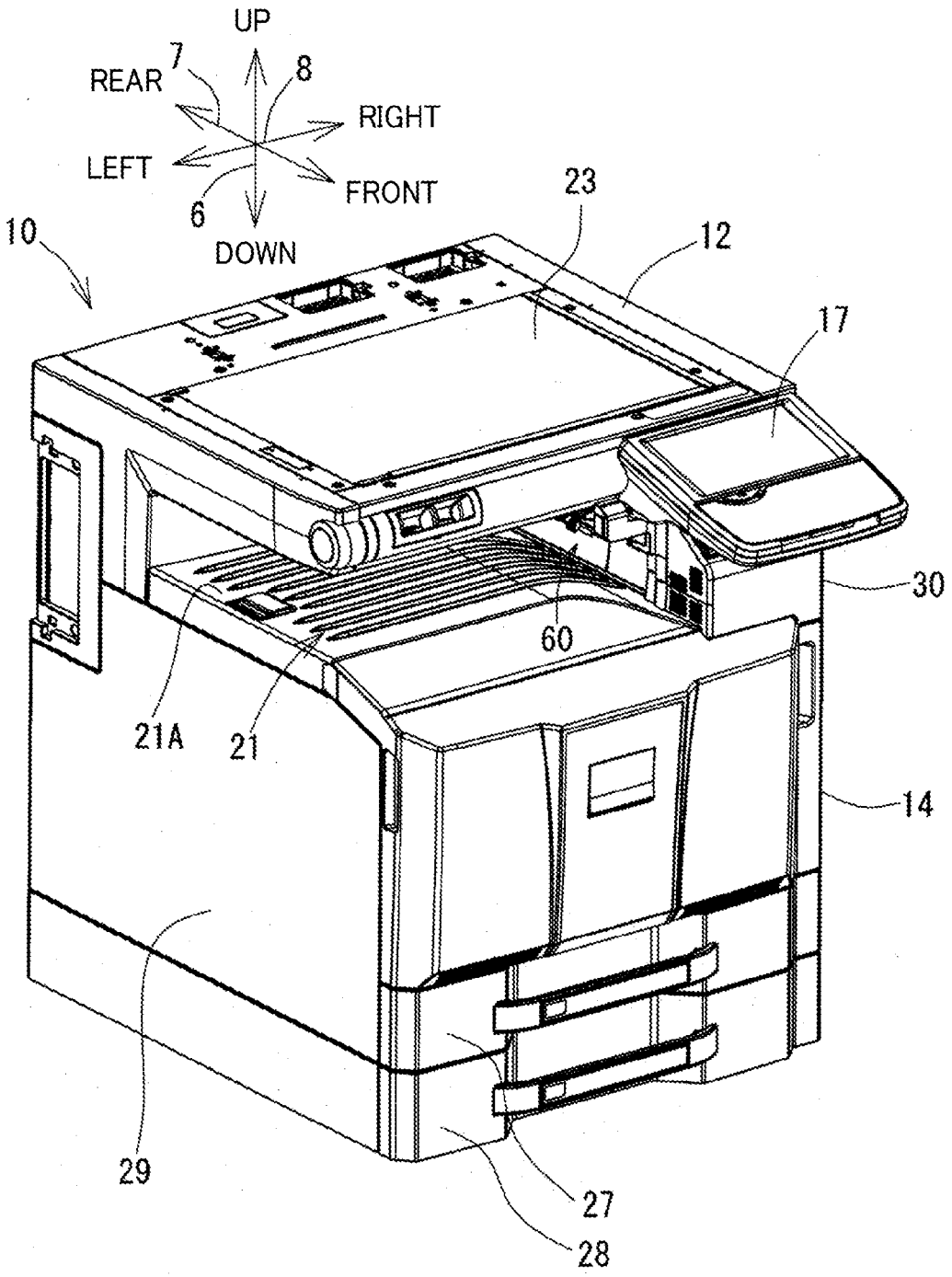
FIG. 1 is a perspective view showing an image forming apparatus according to an embodiment of the present disclosure.

The following describes a sheet conveying device 60 according to an embodiment of the present disclosure and an image forming apparatus 10 including the sheet conveying device 60, with reference to the drawings. It is noted that for the sake of explanation, an up-down direction 6 is defined as the vertical direction in the state (the state shown in FIG. 1) where the image forming apparatus 10 is installed on a flat surface. In addition, a front-rear direction 7 is defined on the supposition that a surface on which an operation display panel 17 is provided is the front surface (front side). Furthermore, a left-right direction 8 is defined based on the front surface of the image forming apparatus 10. It is noted that embodiments described in the following are merely concrete examples of the present disclosure, and are not intended to limit the technical scope of the present disclosure.

First, an outlined configuration of the image forming apparatus 10 will be described with reference to FIGS. 1 through 3. The image forming apparatus 10 is a so-called "in-body discharge type" multifunction peripheral, and has various functions such as a printer, a copier, a facsimile, a scanner, and the like. The image forming apparatus 10 forms an image of an input image onto a print sheet P (an example of the sheet member of the present disclosure) by using a print material such as toner. Note that the image forming apparatus 10 is not limited to a multifunction peripheral, and the present disclosure is also applicable to a specialized device such as a printer, a copier, a facsimile, a scanner including an ADF 13, or the like.

The image forming apparatus 10 includes an image reading portion 12 and an image forming portion 14. The image reading portion 12 performs a process of reading an image from a document sheet, and is provided in the upper portion of the image forming apparatus 10. The image forming portion 14 performs a process of forming an image based on the electrophotography, and is disposed below the image reading portion 12. The image forming portion 14 includes two sheet feed devices 27 and 28 that are arranged as two tiers in the vertical direction. The sheet feed device 27, the upper one of the two sheet feed devices, is integrally formed with a housing 29 in the lowest portion of the image forming portion 14. The sheet feed device 28, the lower one of the two sheet feed devices, is extension-type and is attached to the bottom surface of the housing 29 of the image forming portion 14 as an option device. The sheet feed device 28 is configured to be attachable/dechable to/from the bottom surface of the housing 29. In addition, a paper sheet discharge portion 30 is provided on the right side of the image forming portion 14. It is noted that the image forming method of the image forming portion 14 is not limited to the electrophotography, but may be an inkjet recording method or other recording or printing methods.

Above the image forming portion 14, a sheet discharge space 21, into which print sheets are discharged, is provided. The paper sheet discharge portion 30 is provided such that it couples the image forming portion 14 with the image reading portion 12, with the sheet discharge space 21 formed between the image forming portion 14 and the image reading portion 12. In the present embodiment, as shown in FIG. 1, the front side and the left side of the sheet discharge space 21 are opened. In addition, the rear side and the right side of the sheet discharge space 21 are not opened. The rear side is closed, and on the right side, the paper sheet discharge portion 30 is provided. In the sheet discharge space 21, a sheet discharge tray 21A for holding discharged print sheets P is provided. In the present embodiment, the sheet conveying device 60 is provided in the paper sheet discharge portion 30.

Figure 2:
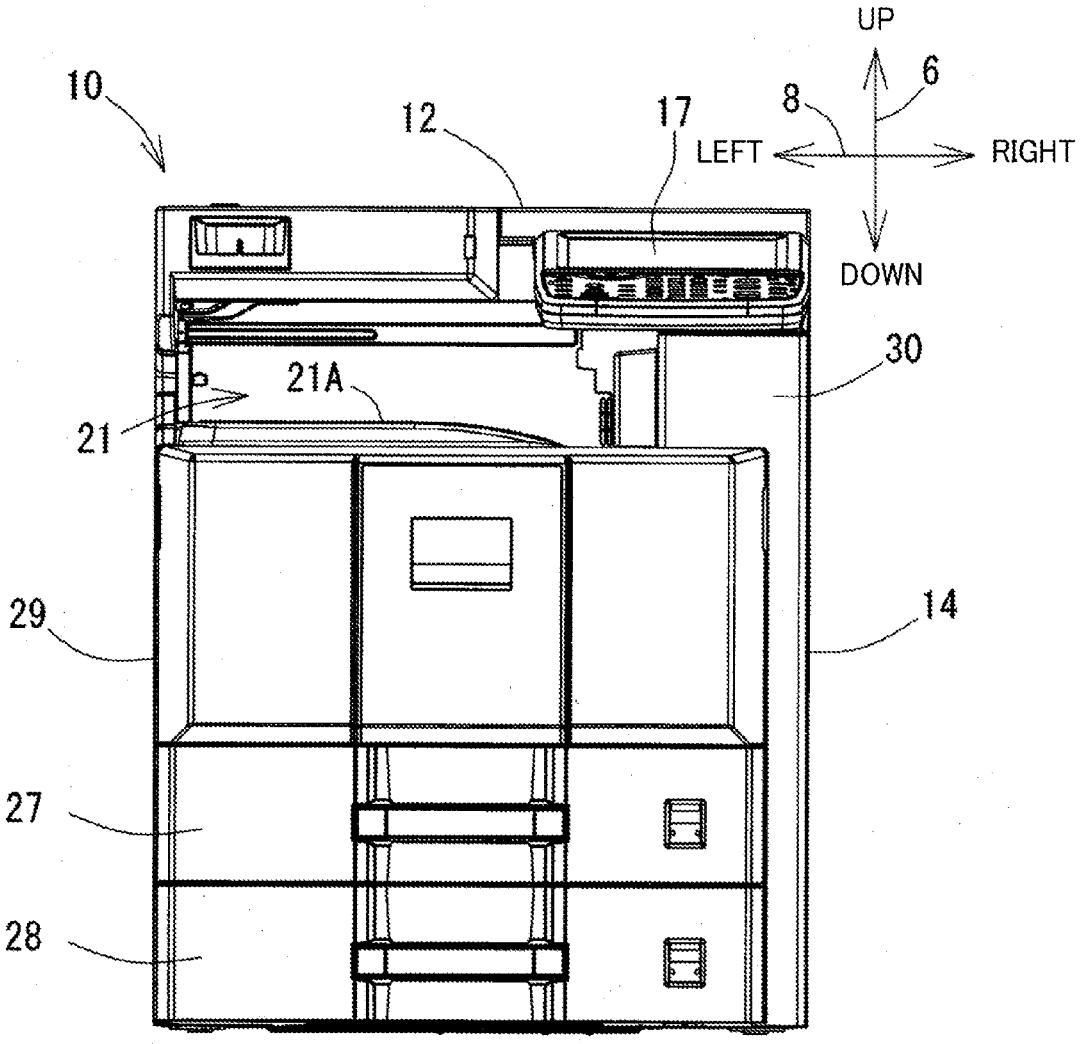
FIG. 2 is a front view showing the front surface of the image forming apparatus of FIG. 1.

As shown in FIG. 1, the image reading portion 12 includes a document sheet placing table 23. When the image forming apparatus 10 functions as a copier, a document sheet is set on the document sheet placing table 23, and when the image forming apparatus 10 functions as a copier, a document sheet is set on the document sheet placing table 23, and after a document sheet cover 24 is closed, a copy start instruction is input from an operation display panel 17. This causes the image reading portion 12 to start the reading operation to read the image data of the document sheet. The read image data is sent to the image forming portion 14. It is noted that in FIGS. 1 and 2, the document sheet cover 24 is omitted (see FIG. 3).

Figure 3:
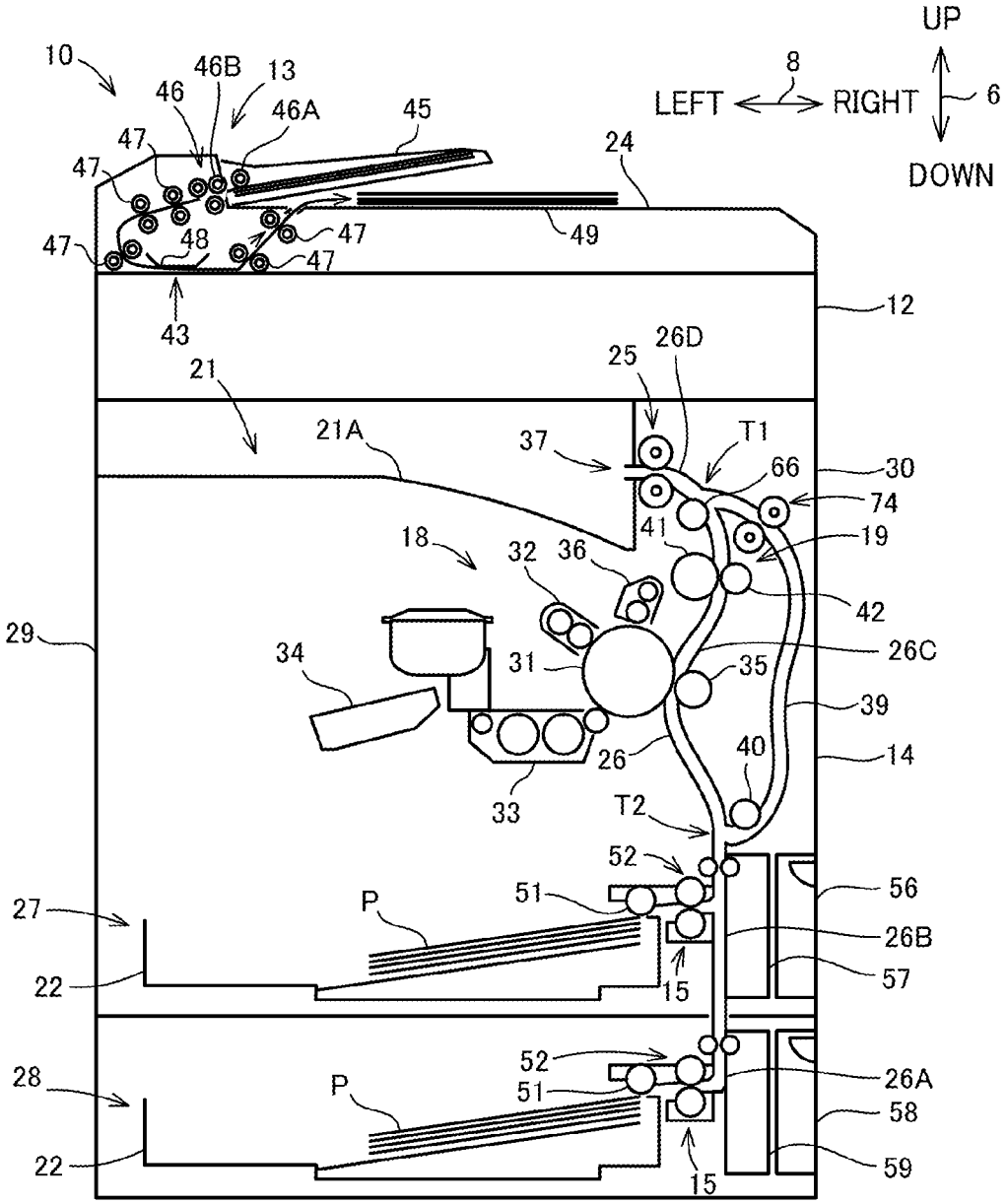
FIG. 3 is a schematic diagram showing the internal configuration of the image forming apparatus of FIG. 1.

In addition, as shown in FIG. 3, the image reading portion 12 includes an ADF 13. The ADF 13 is provided in the document sheet cover 24. The ADF 13 is an automatic document sheet feeding device and includes a document sheet tray 45, a conveying mechanism 46, a plurality of conveying rollers 47, a paper sheet pressing 48, a sheet discharge portion 49, and the like. The ADF 13 drives motors (not shown) to drive the conveying mechanism 46 and the conveying rollers 47, thereby causing a document sheet set on the document sheet tray 45 to pass a reading position 43 provided on the document sheet placing table 23, and to be conveyed to the sheet discharge portion 49. The conveying mechanism 46 includes a feeding roller 46A and a conveying roller 46B. The feeding roller 46A feeds the document sheet, and the conveying roller 46B conveys the document sheet fed by the feeding roller 46A. The document sheet is fed from the document sheet tray 45 by the feeding roller 46A, and is conveyed by the conveying roller 46B toward the downstream side in the conveying direction. The document sheet is further conveyed by a conveying roller 47 that is provided on the downstream side in the conveying direction. The image of the document sheet is read by the image reading portion 12 when the document sheet passes the reading position 43 during the document sheet conveying process performed by the ADF 13.

The image forming portion 14 forms an image on a print sheet P based on the image data which has been read by the image reading portion 12 or input from the outside, wherein the print sheet P has a specific size such as A-size or B-size. In the present embodiment, the image forming portion 14 performs a single side print process (single side image forming process) or a double side print process (double side image forming process) based on a print mode (a single side print mode or a double side print mode) which is set in advance. In the single side print process, an image is formed only on a side of the print sheet P. In the double side print process, images are formed on both sides of the print sheet P. When the single side print process is performed, as described below, the image forming portion 14 discharges a print sheet P with an image formed on a side thereof, into the sheet discharge tray 21A of the sheet discharge space 21. On the other hand, when the double side print process is performed, as described below, the image forming portion 14 switches back a print sheet P with an image formed on a side thereof, sends it into a reverse conveyance path 39 that is described below, forms an image on the reverse side of the print sheet P again, and then discharges the print sheet P with images formed on both sides thereof, into the sheet discharge tray 21A of the sheet discharge space 21.

As shown in FIG. 3, the image forming portion 14 mainly includes sheet feed devices 27, 28, an image transfer portion 18 that is based on the electrophotography, a fixing portion 19, a sheet conveying device 60, a control portion (not shown) for totally controlling the image forming portion 14, or the like. That is, the image forming apparatus 10 includes the sheet conveying device 60. In addition, the image forming portion 14 includes a conveying motor and a discharge motor (both not shown). These portions are provided inside the housing 29 that constitutes the outer frame cover, the internal frame and the like of the image forming portion 14.

The sheet feed devices 27, 28 convey the sheet member to the image transfer portion 18. Each of the sheet feed devices 27, 28 includes a paper sheet housing portion 22 that is in the shape of a tray, and a conveying mechanism 15. The paper sheet housing portion 22 houses a stack of print sheets P (the print sheets P used for image formation) on which images are to be formed by the image transfer portion 18. The conveying mechanism 15 picks up and conveys, one by one, the print sheets P housed in the paper sheet housing portion 22. The conveying mechanism 15 is provided on the upper side of the right-end part of the paper sheet housing portion 22. The conveying mechanism 15 includes a feeding roller 51 and a pair of conveying rollers 52. When an instruction to convey a print sheet P is input into the image forming apparatus 10, the conveying motor is driven and rotated. This causes the feeding roller 51 and the pair of conveying rollers 52 to rotate. The print sheet P is fed from the paper sheet housing portion 22 by the feeding roller 51, and is conveyed toward the downstream side in the conveying direction by the pair of conveying rollers 52.

As shown in FIG. 3, in the image forming portion 14, a vertical conveyance path 26 is formed to extend upward from the pair of conveying rollers 52. The vertical conveyance path 26 is formed in the right-side portion of the housing 29, and extends in the up-down direction 6 along the right side surface. In the following description, the vertical conveyance path 26 is divided into four sections: a first conveyance path 26A; a second conveyance path 26B; a third conveyance path 26C; and a fourth conveyance path 26D. The first conveyance path 26A is formed in the sheet feed device 28. The second conveyance path 26B is formed in the sheet feed device 27. The third conveyance path 26C is formed in a section extending from a merge point T2, which is described below and is near the end of the second conveyance path 26B, to the fixing portion 19. The fourth conveyance path 26D is formed in a section extending from the outlet of the fixing portion 19, passing through a branch point T1 which is described below, and reaching a paper sheet discharge outlet 37 (an example of the sheet discharge outlet of the present disclosure). The fourth conveyance path 26D is an example of the discharge path of the present disclosure. The print sheet P having passed through the fixing portion 19 is guided to the paper sheet discharge outlet 37 by the fourth conveyance path 26D.

The sheet feed device 27 includes an outside cover 56 and an inside cover 57. The outside cover 56 and the inside cover 57 are provided at the right end of the sheet feed device 27. The outside cover 56 and the inside cover 57 are rotatably supported by the housing 29. In the present embodiment, when the outside cover 56 is opened in an opening direction from the closing position shown in FIG. 3, the inside cover 57 is opened in the opening direction in conjunction with the opening operation of the outside cover 56. This causes the second conveyance path 26B in the sheet feed device 27 to be exposed. It is noted that the sheet feed device 28 also includes an outside cover 58 and an inside cover 59 having a similar configuration to those of the sheet feed device 27.

Above the sheet feed device 27, the image transfer portion 18 is provided. The image transfer portion 18 performs an image transfer process onto the print sheet P conveyed from the sheet feed devices 27, 28. Specifically, the image transfer portion 18 transfers, based on the input image data, a toner image onto the print sheet P using a print material such as toner. As shown in FIG. 3, the image transfer portion 18 includes a photoconductor drum 31, a charging portion 32, a developing portion 33, an LSU (Laser Scanning Unit) 34, a transfer roller 35, and a cleaning portion 36.

The photoconductor drum 31 is provided on the left side of the third conveyance path 26C. When the image forming operation is started, the charging portion 32 charges the surface of the photoconductor drum 31 uniformly into a certain potential. In addition, the LSU 34 scans the photoconductor drum 31 by laser light based on the image data. This results in an electrostatic latent image formed on the photoconductor drum 31. The developing portion 33 then causes the toner to adhere to the electrostatic latent image, and a toner image is formed on the photoconductor drum 31. The transfer roller 35 is provided on the right side of the third conveyance path 26C, and is disposed to face the photoconductor drum 31 across the third conveyance path 26C. When the print sheet P conveyed in the third conveyance path 26C passes through a nip portion between the transfer roller 35 and the photoconductor drum 31, the toner image is transferred onto the print sheet P by the transfer roller 35. The print sheet P with the toner image transferred thereon is conveyed in the third conveyance path 26C to the fixing portion 19 that is disposed on the downstream side of (i.e., above) the image transfer portion 18 in the conveyance direction of the print sheet P.

The fixing portion 19 fixes the toner image transferred on the print sheet P to the print sheet P by heat. The fixing portion 19 includes a heating roller 41 and a pressure roller 42. The pressure roller 42 is biased toward the heating roller 41 by an elastic member such as a spring. As a result, the pressure roller 42 is brought into pressure contact with the heating roller 41. During the fixing operation, the heating roller 41 is heated to a high temperature by a heating device 41A (see FIG. 4) such as a heater. When the print sheet P passes through the fixing portion 19, the toner forming the toner image is heated and fused by the heating roller 41, and the print sheet P is pressed by the pressure roller 42. As a result, the toner is fixed to the print sheet P by the fixing portion 19. That is, the toner image is fixed to the print sheet P, and an image is formed on the print sheet P. The print sheet P, after the fixing process, is conveyed by the rollers 41, 42 of the fixing portion 19 to the fourth conveyance path 26D which extends from the fixing portion 19 to the paper sheet discharge outlet 37 described below.

Figure 4:
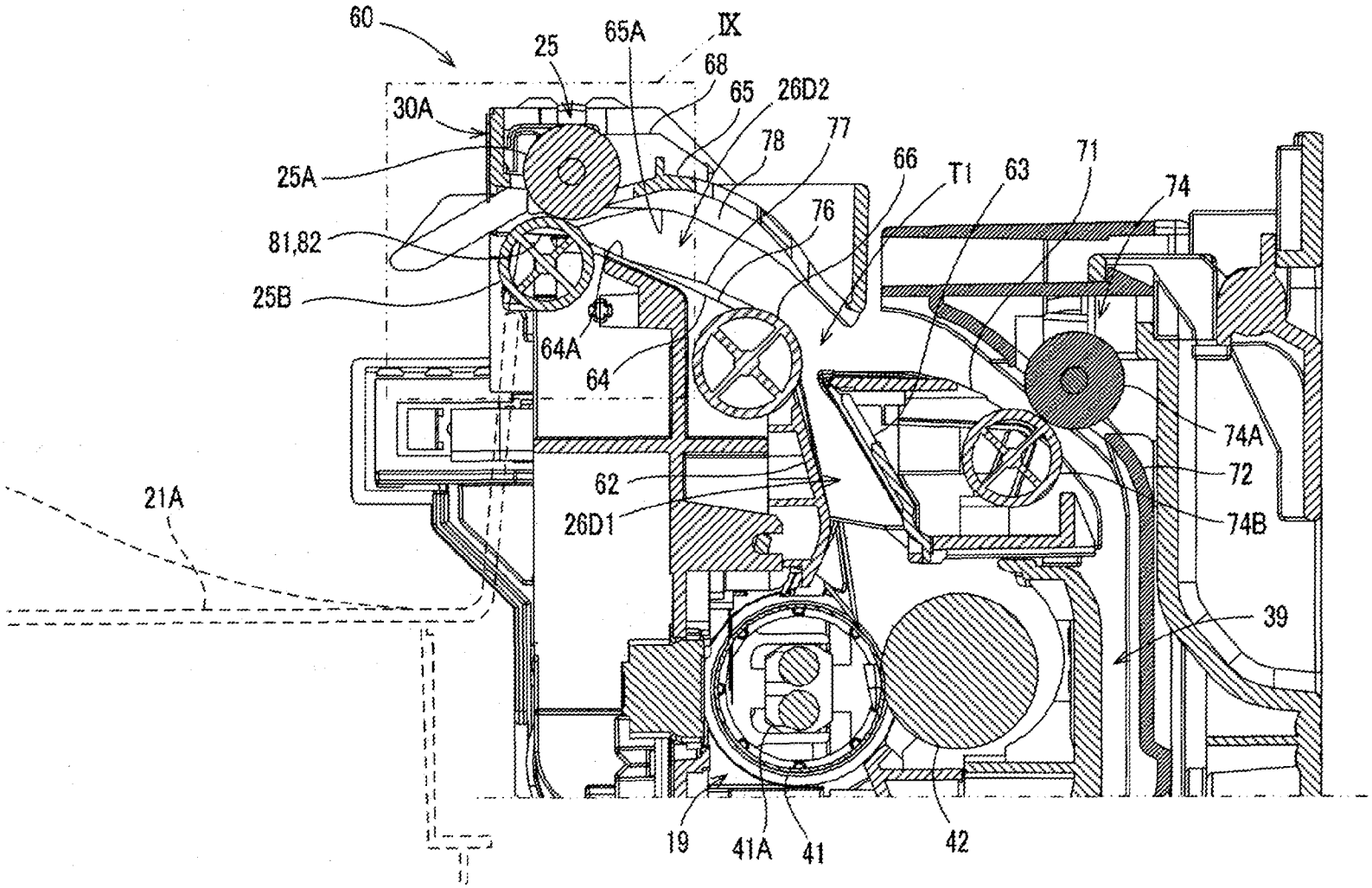
FIG. 4 is a cross sectional view showing the configuration of the peripheral of the sheet conveying device included in the image forming apparatus of FIG. 1.

The sheet conveying device 60 is provided above the fixing portion 19. As shown in FIG. 4, the sheet conveying device 60 includes conveyance guides 62-65, pairs of discharge rollers 25, rolls 66, and stiffening members 81, 82.

Figure 5:
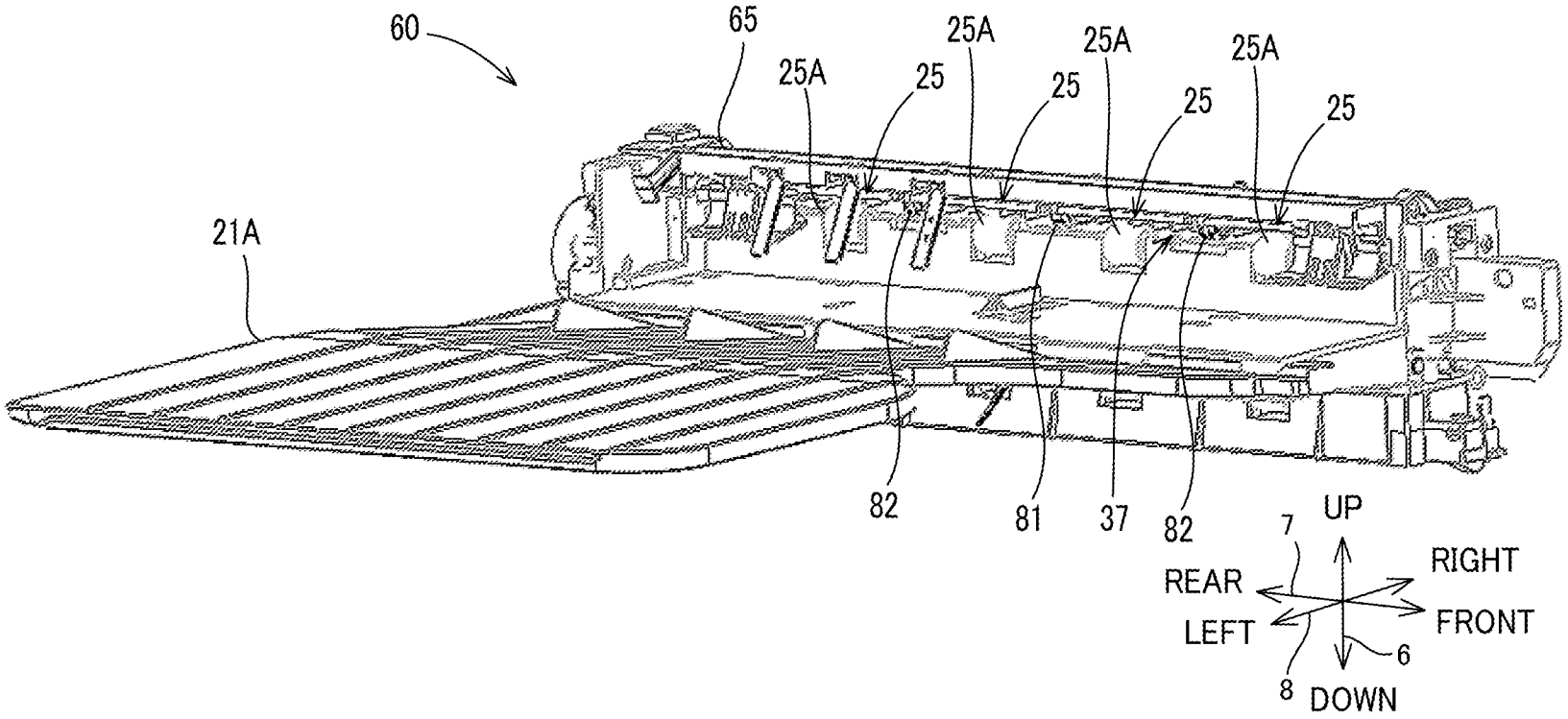
FIG. 5 is a perspective view showing the sheet conveying device of FIG. 4.

As shown in FIGS. 4 and 5, the paper sheet discharge outlet 37 for discharging the print sheet P is formed at the end of the fourth conveyance path 26D of the vertical conveyance path 26. The paper sheet discharge outlet 37 is an opening that is long in the front-rear direction 7 and formed in a left side surface 30A of the paper sheet discharge portion 30. The left side surface 30A of the paper sheet discharge portion 30 is a vertical surface that extends approximately in the up-down direction 6. The paper sheet discharge outlet 37 is exposed to the sheet discharge space 21 from the left side surface 30A.

As shown in FIG. 4, the fourth conveyance path 26D is a conveyance path for guiding the print sheet P with an image fixed thereto by the fixing portion 19, to the paper sheet discharge outlet 37, and is formed in a section extending from a downstream-side outlet of the fixing portion 19 to the paper sheet discharge outlet 37. The fourth conveyance path 26D extends from the fixing portion 19 upward in the vertical direction, and then in the vicinity of the branch point T1, formed in a curved shape curving toward the paper sheet discharge outlet 37. The fourth conveyance path 26D is defined by the plurality of conveyance guides 62-65.

A pair of conveyance guides 62, 63 are formed along a straight path 26D1 which, as a part of the fourth conveyance path 26D, extends from the fixing portion 19 to the branch point T1. The straight path 26D1 is defined by the conveyance guides 62, 63. The conveyance guide 62 is provided on the left side of the straight path 26D1, namely on the heating roller 41 side. The conveyance guide 62 constitutes the guide surface on the left side of the straight path 26D1. The conveyance guide 63 is provided on the right side of the straight path 26D1, namely on the pressure roller 42 side. The conveyance guide 63 constitutes the guide surface on the right side of the straight path 26D1.

A pair of conveyance guides 64, 65 are formed along a curved path 26D2 which, as a part of the fourth conveyance path 26D, extends from the branch point T1 to the paper sheet discharge outlet 37. The curved path 26D2 is defined by the conveyance guides 64, 65. The conveyance guide 64 (an example of the first conveyance guide member of the present disclosure) is provided below the curved path 26D2. The conveyance guide 64 and guide ribs 76, 77, which are described below, constitute a lower guide surface 64A of the curved path 26D2. The conveyance guide 65 (an example of the second conveyance guide member of the present disclosure) is provided above the curved path 26D2. That is, the conveyance guides 64, 65 are disposed to face each other in the up-down direction. The conveyance guide 65 and guide ribs 78, which are described below, constitute an upper guide surface 65A of the curved path 26D2.

The pairs of discharge rollers 25 are provided in the vicinity of the paper sheet discharge outlet 37. Each of the pairs of discharge rollers 25 is a pair of rollers composed of a driving roller 25A (an example of the first discharge roller and the roller portion of the present disclosure) and a driven roller 25B (an example of the second discharge roller and the roller portion of the present disclosure) that are pressed against each other. The driving roller 25A and the driven roller 25B are disposed to face each other across the curved path 26D2. An elastic member is attached to the roller surface of the driving roller 25A, wherein the elastic member is made of rubber or the like having a high sliding friction. The driving roller 25A is rotatably supported at a position above the curved path 26D2. Specifically, the driving roller 25A is rotatably supported by the conveyance guide 65. To the driving roller 25A, rotational driving forces in dual directions are transmitted from the discharge motor (not shown). As a result, the driving roller 25A can be rotated in any of two rotational directions in correspondence with an input rotational driving force. The driving roller 25B is rotatably supported at a position below the curved path 26D2. Specifically, the driving roller 25B is rotatably supported by the conveyance guide 64. The driving roller 25B is biased toward the driving roller 25A by an elastic member (not shown) such as a coil spring. With this configuration, the driven roller 25B is always pressed against the surface of the driving roller 25A by an appropriate elastic biasing force. As a result, when the driving roller 25A is driven and rotated, the driven roller 25B is also driven and rotated by the contact friction.

Figure 6:
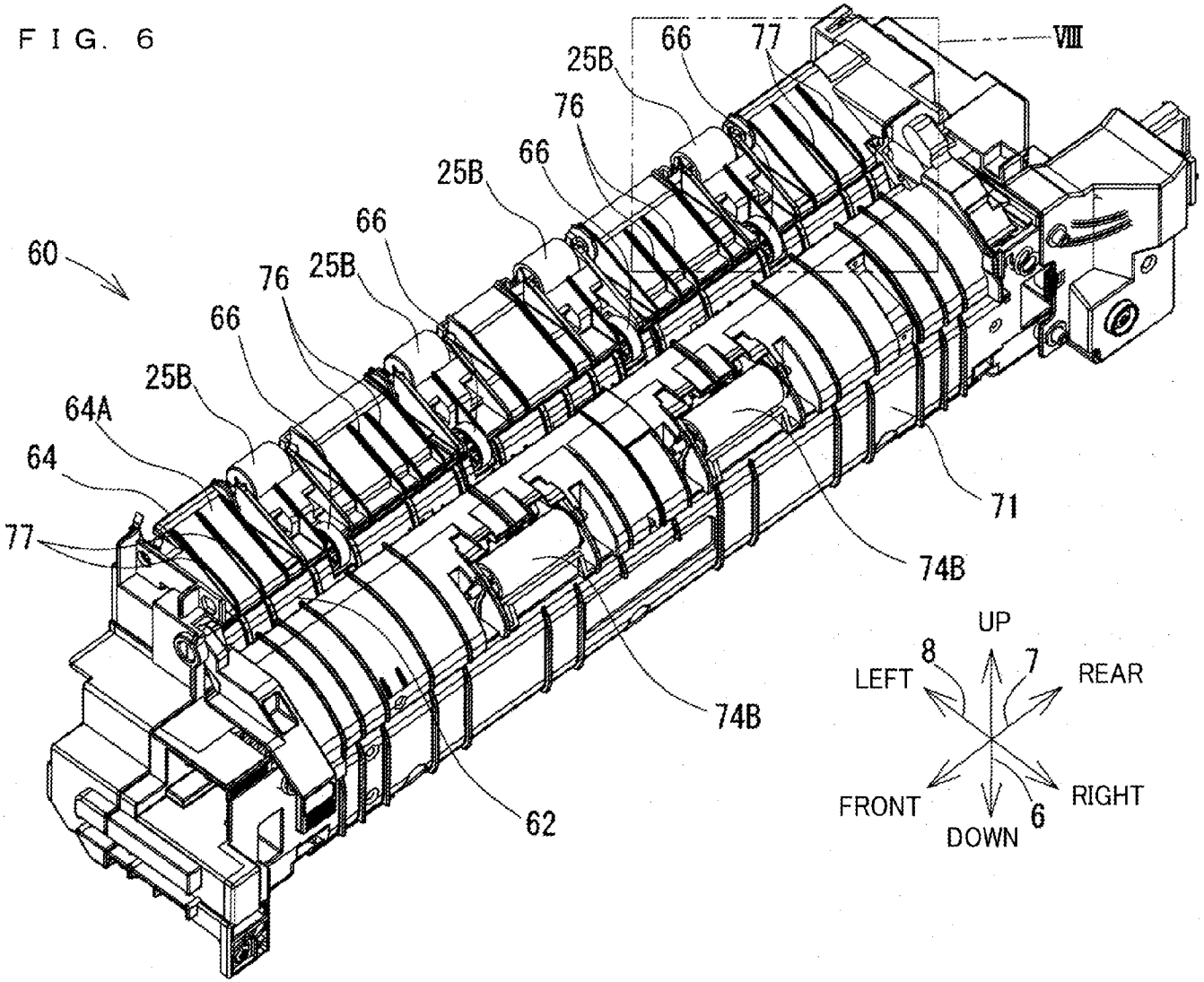
FIG. 6 is a perspective view showing the conveyance guides of the sheet conveying device of FIG. 4.
Figure 7:
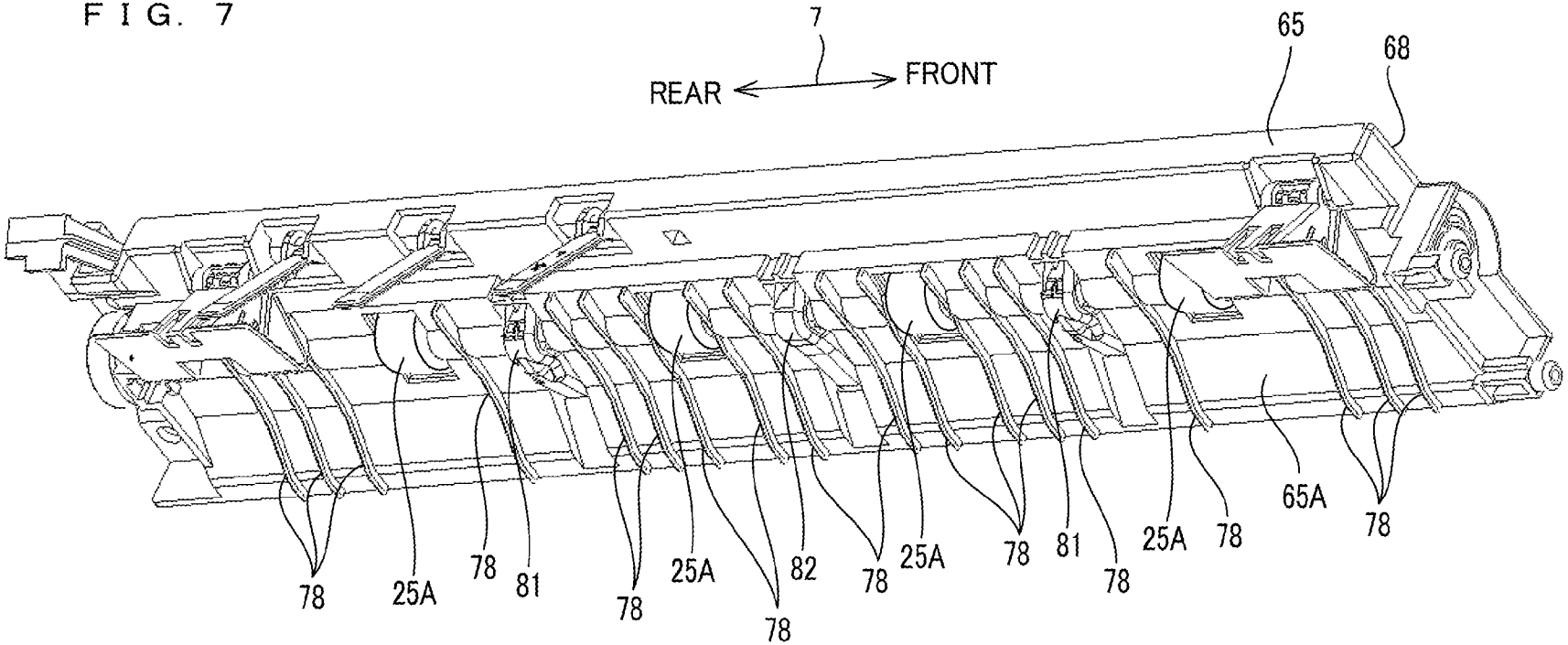
FIG. 7 is a perspective view showing the conveyance guides of the sheet conveying device of FIG. 4.

In the present embodiment, a plurality of pairs of discharge rollers 25 are provided at predetermined intervals along the front-rear direction 7 (corresponding to the width direction of the present disclosure). Specifically, four pairs of discharge rollers 25 are provided as shown in FIGS. 5 through 7. Accordingly, four driving rollers 25A and four driven rollers 25B are provided respectively. It is noted that the driven rollers 25B are not shown in FIG. 5 since they are provided at lower positions and concealed by other members. In addition, in FIG. 6, the conveyance guide 65 provided at an upper position is removed, and thus the driving rollers 25A are not shown in FIG. 6. Furthermore, FIG. 7 is a perspective view showing the conveyance guide 65 provided at an upper position, and thus the driving rollers 25B are not shown in FIG. 7.

The rotational direction of the discharge motor (not shown) is controlled so that the print sheet P is nipped at a nip portion by the driving rollers 25A and the driven rollers 25B of the four pairs of discharge rollers 25, where they are pressed against each other, and is conveyed in either a discharge direction or a reverse direction. The discharge direction is a direction going from the paper sheet discharge outlet 37 to the sheet discharge space 21. The reverse direction is a direction going from the paper sheet discharge outlet 37 to the reverse conveyance path 39 which is described below. For example, a print sheet P having passed through the fixing portion 19 and conveyed to the fourth conveyance path 26D is conveyed in the discharge direction toward the paper sheet discharge outlet 37 by the pairs of discharge rollers 25 that are rotated in the forward direction by the discharge motor. In addition, a print sheet P is conveyed in the reverse direction toward the reverse conveyance path 39 by the pairs of discharge rollers 25 that are rotated in the reverse direction by the discharge motor.

As shown in FIG. 4, the rolls 66 are rotatably provided in the conveyance guide 64 that constitutes the lower guide surface of the curved path 26D2. The roller surfaces of the rolls 66 are exposed in the vicinity of the branch point T1 to the fourth conveyance path 26D. That is, the roller surfaces of the rolls 66 are exposed to the fourth conveyance path 26D from the guide surface of the conveyance guide 64. As a result, the roller surfaces of the rolls 66 contact the print sheet P when the print sheet P passes through the fourth conveyance path 26D. That is, the rolls 66 contact an image-formed surface of the print sheet P passing through the branch point T1. Specifically, the rolls 66 contact the print sheet P at a position that is away from the guide surface of the conveyance guide 64 by a distance between the guide surface and each roller surface. By contacting the print sheet P moving in the fourth conveyance path 26D toward the paper sheet discharge outlet 37, the rolls 66 are rotated by the contact friction.

As shown in FIG. 6, four rolls 66 are provided at predetermined intervals along the front-rear direction 7 (corresponding to the width direction of the present disclosure). Specifically, the four rolls 66 are disposed at the same positions where the four pairs of discharge rollers 25 are provided in the front-rear direction 7, respectively.

When the single side print process is performed in the image forming portion 14, a print sheet P, with a toner image transferred on a side thereof by the image transfer portion 18, is passed through the fixing portion 19, conveyed in the fourth conveyance path 26D, and discharged from the paper sheet discharge outlet 37 to outside by the four pairs of discharge rollers 25.

On the other hand, when the double side print process is performed in the image forming portion 14, first a print sheet P with an image formed on a side thereof is passed through the fixing portion 19, and then conveyed in the fourth conveyance path 26D in the reverse direction and sent into the reverse conveyance path 39. Specifically, the pairs of discharge rollers 25 are stopped in the state where the front end of the print sheet P in the discharge direction, with an image formed on a side thereof, is exposed from the paper sheet discharge outlet 37 to outside. At this time, the rear end of the print sheet P in the discharge direction is held in the state where it is nipped by the pairs of discharge rollers 25. Then, the pairs of discharge rollers 25 are rotated in the reverse direction by the reverse rotation driving of the discharge motor (not shown). This causes the print sheet P to be conveyed in the fourth conveyance path 26D in the reverse direction. That is, the print sheet P is conveyed backward (by switchback conveyance) in the fourth conveyance path 26D.

As shown in FIG. 3, the reverse conveyance path 39 is formed in the sheet conveying device 60, wherein the reverse conveyance path 39 branches from the fourth conveyance path 26D at the branch point T1. During the double side print process, the print sheet P, when it is conveyed in the reverse direction in the fourth conveyance path 26D, passes over the branch point T1 and enters the reverse conveyance path 39. Branching at the branch point T1, the reverse conveyance path 39 extends curving diagonally downward right, and then extends downward straight in the vertical direction. At the lower end thereof, the reverse conveyance path 39 merges with the third conveyance path 26C at the merge point T2, which is positioned on the upstream side in the conveyance direction of the print sheet P when viewed from the image transfer portion 18 side. That is, the reverse conveyance path 39 extends from the branch point T1 to the merge point T2. The reverse conveyance path 39 is formed inside the image forming portion 14, on the right side of the vertical conveyance path 26. The reverse conveyance path 39 extends in the up-down direction 6 (vertical direction) approximately in parallel with the vertical conveyance path 26.

As shown in FIG. 4, a plurality of conveyance guides 71-73 are provided inside the image forming portion 14. The conveyance guides 71-73 are provided along the reverse conveyance path 39. That is, the reverse conveyance path 39 is defined by the plurality of conveyance guides 71-73. Specifically, the conveyance guide 71 is provided on the left side of the reverse conveyance path 39, namely on the vertical conveyance path 26 side. The conveyance guide 71 constitutes the guide surface on the left side of the reverse conveyance path 39. In addition, the conveyance guide 72 is provided on the right side of the reverse conveyance path 39. The conveyance guide 72 constitutes the guide surface on the right side of the reverse conveyance path 39. It is noted that the conveyance guide 72 may be provided in the housing 29 or may be constituted by an inner surface of a cover member that is openable/closable to open/close the right side surface of the image forming portion 14.

Pairs of conveyance rollers 74 are provided in a curved portion above the reverse conveyance path 39. Each of the pairs of conveyance rollers 74 is a pair of rollers composed of a driving roller 74A and a driven roller 74B that are pressed against each other. An elastic member is attached to the roller surface of the driving roller 74A, wherein the elastic member is made of rubber or the like having a high sliding friction. The driving roller 74A is rotatably supported by the conveyance guide 72. In addition, the driven roller 74B is rotatably supported by the conveyance guide 71. In the present embodiment, as shown in FIG. 6, two pairs of conveyance rollers 74 are provided in the vicinity of the center in the front-rear direction 7 to be separated from each other by a predetermined distance. When the rotational driving force of the reverse direction is input to the driving rollers 74A from the discharge motor, the pairs of conveyance rollers 74 convey the print sheet P that has entered the reverse conveyance path 39 from the branch point T1, toward the merge point T2 (reverse direction).

The guide surface 64A of the conveyance guide 64 includes inside guide ribs 76 and outside guide ribs 77 that are different in height. The guide ribs 76, 77 are integrally formed with the conveyance guide 64. As shown in FIG. 6, the guide ribs 76, 77 are projections each in the shape of an elongated plate with a narrow width, projecting upward from the guide surface 64A of the conveyance guide 64, and extending in the conveyance direction of the print sheet P in the curved path 26D2. In other words, the guide ribs 76, 77 are extended in the direction in which the print sheet P is guided by the conveyance guides 64, 65.

Figure 9:
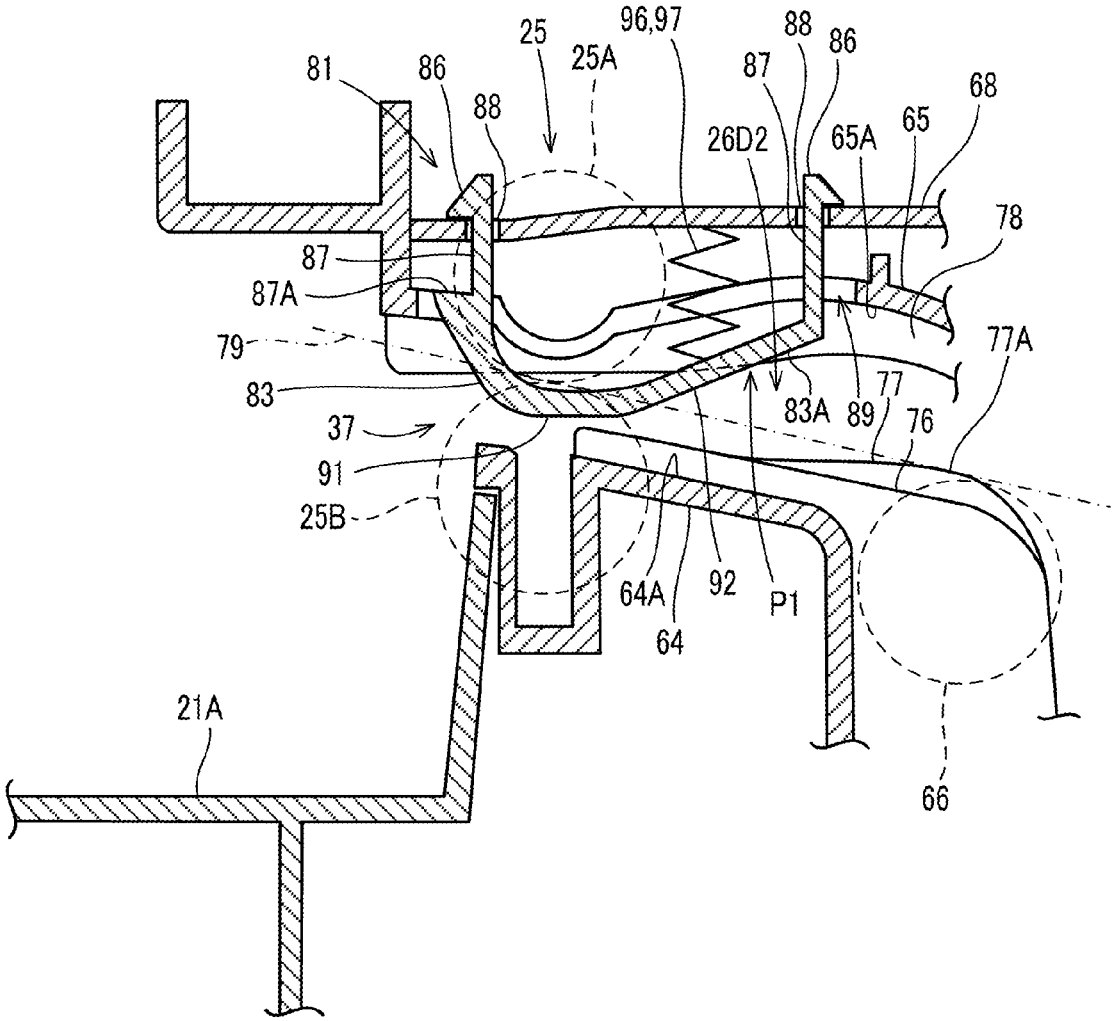
FIG. 9 is a schematic diagram schematically showing the configuration of a main part IX of FIG. 4.

Specifically, a plurality of inside guide ribs 76 are formed in an area inside of the pairs of discharge rollers 25 in the front-rear direction 7 (width direction). More specifically, a plurality of inside guide ribs 76 are formed in an area inside of two pairs of discharge rollers 25, among the four pairs of discharge rollers 25, that are located at the opposite ends in the width direction. The inside guide ribs 76 are formed to the same height. In the present embodiment, as shown in FIG. 9, the inside guide ribs 76 are formed to be lower than a reference straight line 79, wherein the reference straight line 79 is a straight line connecting: the nip portion (pressure-contact point) between the driving roller 25A and the driven roller 25B of each pair of discharge rollers 25; and the contact point of the print sheet P and each roll 66.

Figure 8:
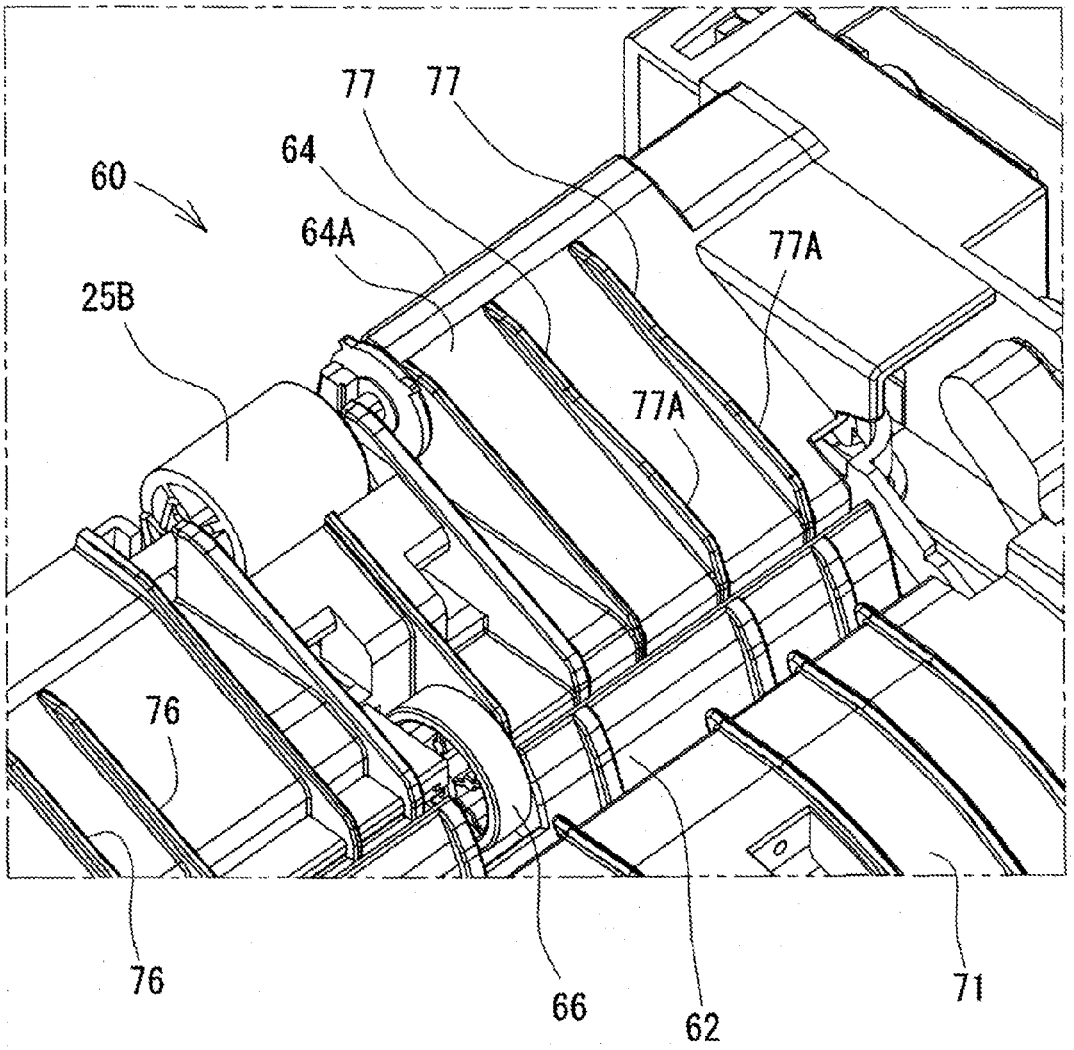
FIG. 8 is a partially engaged view of a main part VIII of FIG. 6.

In addition, a plurality of outside guide ribs 77 are formed in areas outside of the pairs of discharge rollers 25 in the front-rear direction 7 (width direction). The plurality of outside guide ribs 77 are formed in areas outside of the two pairs of discharge rollers 25 that are located at the opposite ends in the width direction. That is, two outside guide ribs 77 are formed at each of the opposite ends of the conveyance guide 64 in the width direction. The outside guide ribs 77 are formed to be higher in position than the inside guide ribs 76. Specifically, as shown in FIGS. 8 and 9, each outside guide rib 77 is formed such that its end on the paper sheet discharge outlet 37 side has approximately the same height as each inside guide rib 76, and it gradually becomes higher toward the branch point T1. That is, a portion 77A, which is a half portion of each outside guide rib 77 on the branch point T1 side, is formed to be higher than each inside guide rib 76. In the present embodiment, as shown in FIG. 9, the portion 77A of each outside guide rib 77 is formed to have the same height as the reference straight line 79.

As shown in FIG. 7, a plurality of guide ribs 78 (an example of the guide rib of the present disclosure) are provided in the guide surface 65A of the conveyance guide 65. The plurality of guide ribs 78 are provided at predetermined intervals in the front-rear direction 7 (width direction). The guide ribs 78 guide the front end of the print sheet P in the conveyance direction conveyed in the fourth conveyance path 26D, to the nip portion. The guide ribs 78 are integrally formed with the conveyance guide 65. The guide ribs 78 are projections each in the shape of an elongated plate with a narrow width, projecting downward from the guide surface 65A of the conveyance guide 65, and extending in the conveyance direction of the print sheet P in the curved path 26D2. In other words, the guide ribs 78 are extended in the direction in which the print sheet P is guided by the conveyance guides 64, 65. Projection ends of the plurality of guide ribs 78 form a guide surface (an example of the conveyance guide surface of the present disclosure) that guides the print sheet P inside the fourth conveyance path 26D (on the driving roller 25A side). The guide surface formed by the projection ends of the guide ribs 78 may constitute a part of the guide surface 65A of the conveyance guide 65.

As shown in FIG. 7, the conveyance guide 65 includes two stiffening members 81 (an example of the first stiffening member of the present disclosure) and a stiffening member 82 (an example of the second stiffening member of the present disclosure). The stiffening members 81, 82 stiffen the print sheet P by contacting and pressing the print sheet P conveyed in the fourth conveyance path 26D.

Meanwhile, conventional, typical stiffening members project in the vicinity of the pair of discharge rollers 25 in a direction perpendicular to the paper surface of the print sheet P. As a result, when the print sheet P is conveyed in the discharge direction toward the paper sheet discharge outlet 37, the front end of the print sheet P in the discharge direction contacts the stiffening members, and the load obtained thereby may disturb the discharge of the print sheet P. In particular, coated paper such as glossy paper has a high sliding resistance on its surface, and thus the conveyance thereof in the discharge direction may be stopped by the load of the contact friction by the contact with the conventional stiffening members, and a paper jam may be generated. On the other hand, when the contacting parts of the conventional stiffening members, which contact the print sheet P, are made small to reduce the load by the contact with the print sheet P, creases extending in the discharge direction may be generated in the print sheet P. The stiffening members 81, 82 of the present disclosure can stiffen the print sheet P appropriately when the print sheet P is discharged from the paper sheet discharge outlet 37, and enable the print sheet P to be discharged smoothly without having creases.

The stiffening member 82 is provided in the center of the conveyance guide 65 in the front-rear direction 7, and disposed between the two driving rollers 25A provided at positions closer to the center. The stiffening members 81 are provided on both sides of the stiffening member 82 and separated in the front-rear direction 7. A stiffening member 81 is disposed between two driving rollers 25A provided on the front side, and the other stiffening member 81 is disposed between two driving rollers 25A provided on the rear side.

FIG. 9 schematically shows the sectional configuration of the peripheral of each stiffening member 81. As shown in FIG. 9, the stiffening member 81 projects downward from the guide surface 65A, which is the upper guide surface of the fourth conveyance path 26D, toward the fourth conveyance path 26D. In other words, the stiffening member 81 projects from the guide surface 65A in a direction of crossing with the conveyance direction of the print sheet P in the fourth conveyance path 26D. As a result, the stiffening member 81 contacts the print sheet P conveyed in the fourth conveyance path 26D. Upon contacting the print sheet P, the stiffening member 81 presses and curves the print sheet P downward. This allows for the print sheet P to have high stiffness. It is noted that although not shown in FIG. 9, the stiffening member 82, like the stiffening members 81, projects downward from the guide surface 65A, which is the upper guide surface of the fourth conveyance path 26D, toward the fourth conveyance path 26D. As a result, the stiffening member 82 contacts the print sheet P conveyed in the fourth conveyance path 26D. Upon contacting the print sheet P, the stiffening member 82 presses and curves the print sheet P downward. This allows for the print sheet P to have high stiffness. The print sheet P having been stiffened by the stiffening members 81, 82 is curved in a waveform shape when viewed from the downstream side in the conveyance direction of the print sheet P (from the front side of the print sheet P).

The stiffening members 81, 82 are attached in the state where they are in part embedded in openings 89 that are formed between the driving rollers 25A. Specifically, the stiffening members 81, 82 includes main bodies 83, 84 that contact the print sheet P, and each of the main bodies 83, 84 includes two arms 87. The two arms 87 extend from each of the main bodies 83, 84 upward and are separated from each other in the conveyance direction of the print sheet P. Each arm 87 has a downward hook 86. Further above the opening 89 of the conveyance guide 65, a mounting plate 68 is integrally provided with the conveyance guide 65. Through holes 88 are formed in the mounting plate 68. The hooks 86 are passed through the through holes 88, thereby the stiffening members 81, 82 are attached to the mounting plate 68 in the state where they are in part embedded in the openings 89. The hooks 86 are hooked to the mounting plate 68 in the state where they are passed through the through holes 88. This restricts the stiffening members 81, 82 from being displaced downward. On the other hand, each arm 87 of the stiffening members 81, 82 that is provided on the downstream side in the conveyance direction includes an upward hook 87A. With this configuration, the stiffening members 81, 82 can be displaced upward until the hooks 87A abut the mounting plate 68. It is noted that the mounting plate 68 may be integrally formed with the conveyance guide 65, or may be configured from a frame or the like that is different from the conveyance guide 65.

It is noted that the stiffening members 81, 82 are biased downward by the elastic force of elastic members 96, 97 such as coil springs. With the elastic force of the elastic members 96, 97, the stiffening members 81, 82 have a force to press down the conveyed print sheet P. Specifically, each of the stiffening members 81 is biased by the elastic member 96 in a direction of going away downward from the guide surface 65A. The elastic member 96 is an example of the first elastic member of the present disclosure. In addition, the stiffening member 82 is biased by the elastic member 97 in a direction of going away downward from the guide surface 65A. The elastic member 97 is an example of the second elastic member of the present disclosure. In the present embodiment, the biasing force of the elastic member 97 is set to be smaller than the biasing force of the elastic member 96. That is, the spring coefficient of the elastic member 97 is smaller than the spring coefficient of the elastic member 96. Accordingly, the force of the elastic member 97 to press the print sheet P is weaker than the pressing force of the elastic member 96.

Figure 10A:
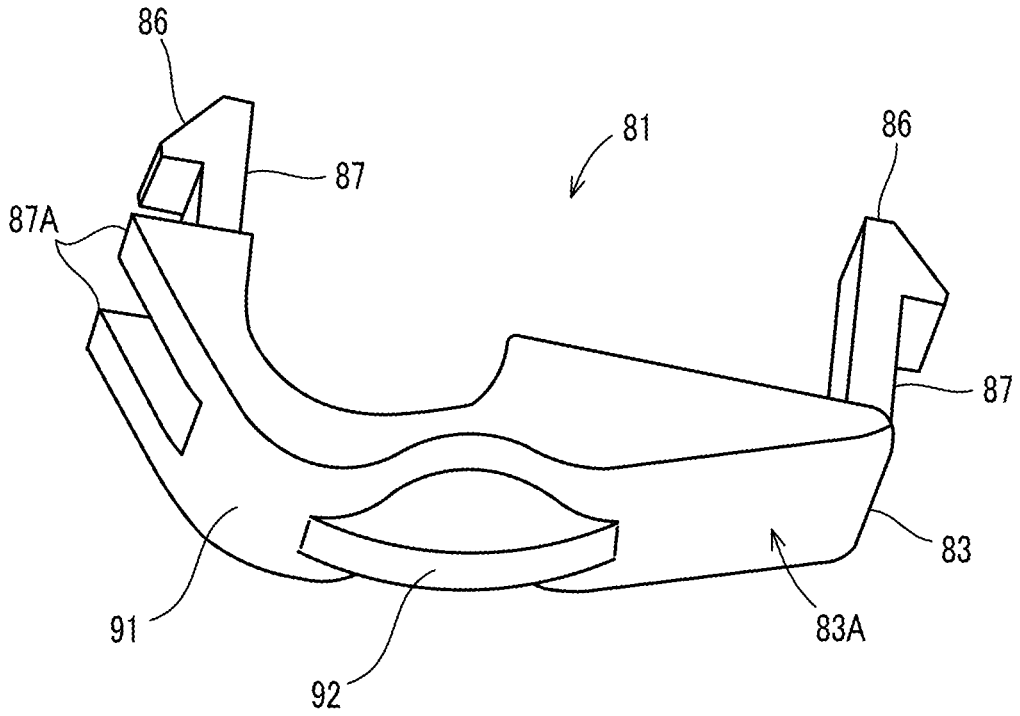
FIGS. 10A and 10B are perspective views of a stiffening member included in the sheet conveying device of FIG. 4.
Figure 10B:
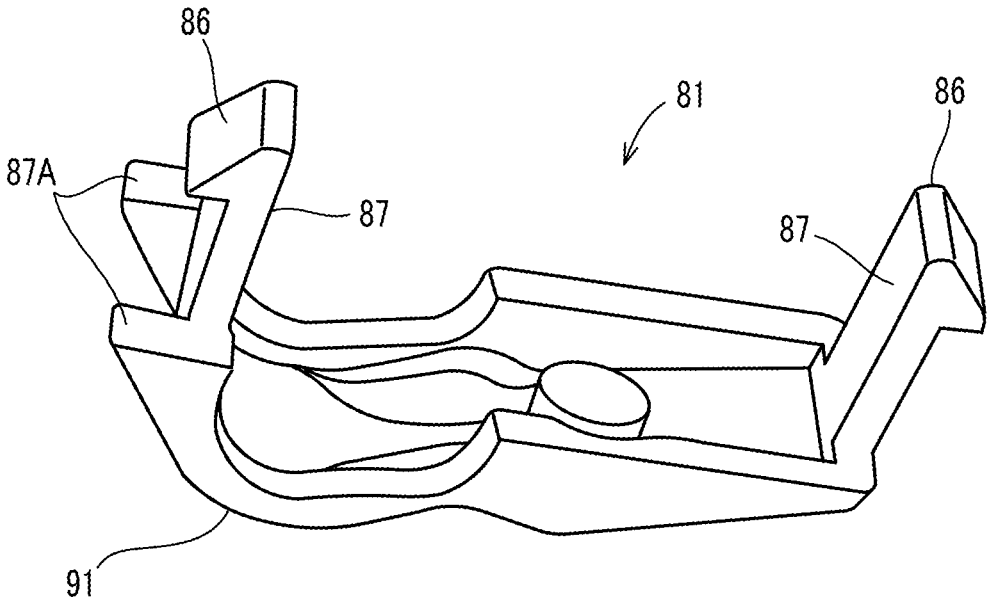

FIGS. 10A and 10B are perspective views of the stiffening member 81. The stiffening member 81 is a synthetic resin product that is integrally formed from a synthetic resin (for example, POM) having a low sliding resistance. As shown in FIGS. 10A and 10B, each stiffening member 81 includes a first pressing portion 91 and a guide portion 92. The first pressing portion 91 and the guide portion 92 are provided in the main body 83 of each stiffening member 81. The main body 83 is provided to extend from the nip portion of the pairs of discharge rollers 25 to the upstream side in the conveyance direction of the print sheet P. The first pressing portion 91 and the guide portion 92 are provided in a facing surface 83A of the main body 83, wherein the facing surface 83A faces the print sheet P. The first pressing portion 91 is provided at a position that corresponds to the nip portion of the pairs of discharge rollers 25 when viewed from one side in the width direction of the fourth conveyance path 26D, namely the direction perpendicular to the conveyance direction of the print sheet P. Specifically, the first pressing portion 91 is positioned more on the side of the lower guide surface 64A of the fourth conveyance path 26D than the nip portion of the pairs of discharge rollers 25, namely positioned more on the driven roller 25B side. The first pressing portion 91 is formed in a portion of the facing surface 83A of the main body 83 that is on the downstream side in the conveyance direction of the print sheet P. On the other hand, the guide portion 92 is formed more on the upstream side in the conveyance direction of the print sheet P in the fourth conveyance path 26D than the first pressing portion 91. The guide portion 92 projects farther than the projection ends of the guide ribs 78 toward the fourth conveyance path 26D. In the present embodiment, the guide portion 92 is formed to have a narrower width than the first pressing portion 91 in the width direction perpendicular to the conveyance direction in the fourth conveyance path 26D. According to FIGS. 10A and 10B, the width of the guide portion 92 is approximately a third of the width of the first pressing portion 91. It is noted, however, that the width sizes of the first pressing portion 91 and the guide portion 92 are set as appropriate based on the factors such as the spring force of the elastic member 96, the print sheet P conveyance speed, the distance from the nip portion of the pairs of discharge rollers 25, and the like.

As shown in FIG. 9, in the facing surface 83A of the main body 83 when viewed from one side in the width direction, a portion of the facing surface 83A that extends from the guide portion 92 of the stiffening member 81 to the upstream side in the conveyance direction of the print sheet P, crosses, at position P1, with the conveyance guide surface formed by the projection end of the guide rib 78. Specifically, the guide rib 78 projects farther toward the fourth conveyance path 26D than the end of the facing surface 83A of the main body 83 on the upstream side in the conveyance direction of the print sheet P. As a result, when viewed from one side in the width direction, a portion of the facing surface that extends from the guide portion 92 to the upstream side crosses, at position P1, with the conveyance guide surface. The first pressing portion 91 is positioned lower than the projection end of the guide rib 78. In addition, the guide portion 92 is provided in the vicinity of the position P1 (see FIG. 9). Specifically, the first pressing portion 91 is positioned lower than the projection end of the guide rib 78, and disposed in an area ranging from the position P1 to the first pressing portion 91 on the downstream side in the conveyance direction of the print sheet P. With this configuration, when the print sheet P is conveyed in the fourth conveyance path 26D that is in the curved shape, the front end of the print sheet P is first guided by the guide ribs 78 toward the nip portion of the pairs of discharge rollers 25 while abutting the guide ribs 78. When the print sheet P is further conveyed, the front end of the print sheet P abuts the facing surface 83A at the position P1 and is guided by the facing surface 83A to the downstream side in the conveyance direction. Subsequently, the front end of the print sheet P reaches and abuts the guide portion 92 and is guided by the guide portion 92 toward the first pressing portion 91.

Figure 11:
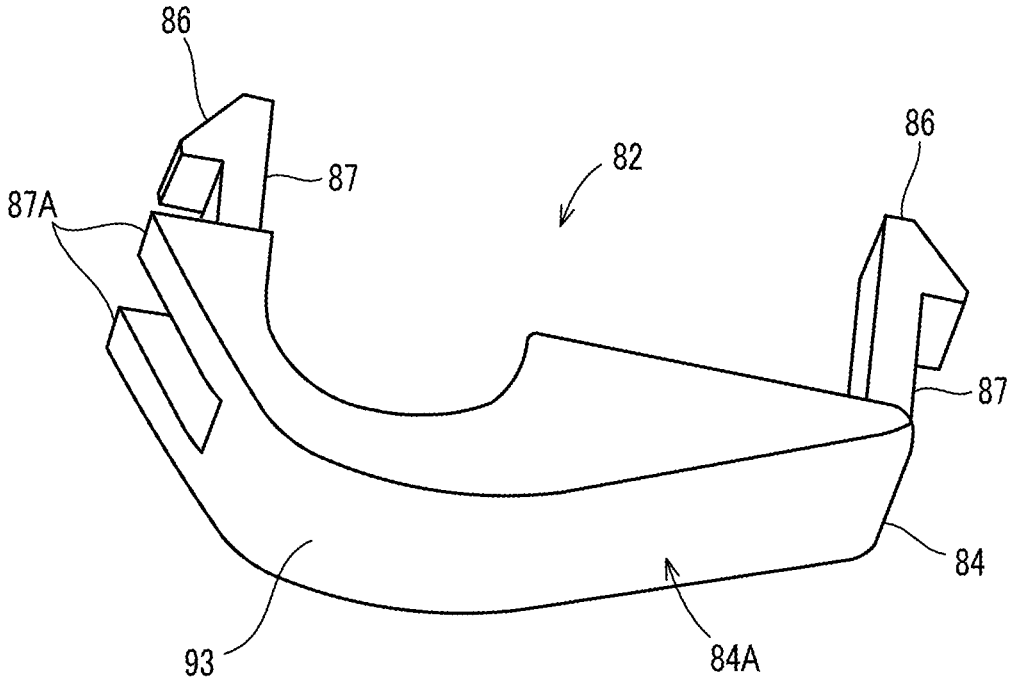
FIG. 11 is a perspective view of a stiffening member included in the sheet conveying device of FIG. 4.

FIG. 11 is a perspective view of the stiffening member 82. The stiffening member 82, like the stiffening member 81, is a synthetic resin product that is integrally formed from a synthetic resin (for example, POM) having a low sliding resistance. As shown in FIG. 11, the stiffening member 82 includes a second pressing portion 93 that contacts and presses the print sheet P. The second pressing portion 93 is provided in a main body 84 of the stiffening member 82. The stiffening member 82 is different in shape from the stiffening member 81, and does not have a counterpart of the guide portion 92. Specifically, the whole of a facing surface 84A of the main body 84 that faces the print sheet P constitutes the second pressing portion 93 that has the same width as the first pressing portion 91.

With the above-described configuration of the stiffening members 81, 82, the print sheet P is guided as follows. That is, the print sheet P, with an image fixed thereon by the fixing portion 19, is conveyed in the fourth conveyance path 26D toward the paper sheet discharge outlet 37. The print sheet P is conveyed in the curved path 26D2 in the curved form, guided by the guide ribs 78 of the guide surface 65A such that the front end of the print sheet P moves toward the nip portion of the pairs of discharge rollers 25. During this conveyance, the front end of the print sheet P is guided toward the nip portion along the guide ribs 78. When the front end of the print sheet P reaches the position P1 (see FIG. 9), the front end of the print sheet P abuts the guide portion 92 of the stiffening member 81 at a position that is more on the upstream side in the conveyance direction than the nip portion. As described above, the guide portion 92 is formed to have a narrow width. As a result, the guide portion 92 does not apply a high load to the print sheet P. Thus, when the print sheet P abuts the guide portion 92, the conveyance of the print sheet P is not disturbed by the guide portion 92. The front end of the print sheet P abutting the guide portion 92 proceeds smoothly to the nip portion of the pairs of discharge rollers 25 while receiving a low load. Then at the same time as the front end of the print sheet P is nipped by the pairs of discharge rollers 25, the first pressing portions 91 of the stiffening members 81 and the second pressing portion 93 of the stiffening member 82 press down the print sheet P to a position lower than the nip portion. Here, since the print sheet P is pressed by the wide portions, the print sheet P is bent without a crease in a waveform shape and given a high stiffness. It is noted that there may be a case where the front end of the print sheet P abuts the second pressing portion 93 of the stiffening member 82 before the front end of the print sheet P reaches the nip portion. However, since the spring force of the elastic member 97 of the stiffening member 82 is weak, the second pressing portion 93 does not apply a high load to the front end of the print sheet P, and the conveyance of the print sheet P is not disturbed by the second pressing portion 93.

It is noted that, since a high stiffness is not required around the center of the print sheet P, the above-described embodiment discloses, as an example, a configuration where the stiffening member 82 is provided at the center in the width direction of the guide surface 65A. However, the present disclosure is not limited to this configuration. For example, instead of the stiffening member 82, the stiffening member 81 may be provided at the center. In addition, the above-described embodiment discloses, as an example, a configuration where a plurality of stiffening members 81 are provided. However, not limited to this configuration, at least one stiffening member 81 may be provided. In the case where a stiffening member 81 is provided, the stiffening member 81 is preferably provided at the center in the width direction of the guide surface 65A.

The above-described embodiment discloses, as an example, a configuration where the stiffening members 81, 82 are attached to the upper guide surface 65A. However, not limited to this configuration, the stiffening members 81, 82 may be attached to the lower guide surface 64A.

The above-described embodiment discloses, as an example, the sheet conveying device 60 in which the print sheet P is discharged from the image forming portion 14. However, the present disclosure is not limited to this configuration. For example, the present disclosure is applicable to a mechanism of the ADF 13 in which the document sheet is discharged to the sheet discharge portion 49 by the conveying roller 47.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a first conveyance guide member and a second conveyance guide member disposed to face each other and forming a discharge path extending to a sheet discharge outlet;

a first discharge roller and a second discharge roller disposed to face each other across the discharge path and configured to nip a sheet member conveyed in the discharge path in a sheet conveyance direction toward the sheet discharge outlet and discharge the sheet member from the sheet discharge outlet to outside, the first discharge roller being provided in the first conveyance guide member, the second discharge roller being provided in the second conveyance guide member; and at least one first stiffening member disposed on an upstream side relative to the sheet discharge outlet in the sheet conveyance direction, projecting toward the discharge path from one of the first conveyance guide member and the second conveyance guide member and extending from a nip portion to the upstream side in the sheet conveyance direction, and configured to stiffen the sheet member by contacting and pressing the sheet member conveyed in the discharge path, the nip portion being formed by the first discharge roller and the second discharge roller, the at least one first stiffening member including:

a first pressing portion provided in a facing surface that faces the sheet member, and arranged at a position that corresponds to the nip portion when viewed from one side in a width direction of the discharge path that is a direction perpendicular to the sheet conveyance direction, the first pressing portion projecting farther toward the other of the first conveyance guide member and the second conveyance guide member than the nip portion so as to contact and press the sheet member; and a guide portion provided in the facing surface, and arranged at a position more on the upstream side in the sheet conveyance direction than the first pressing portion, and arranged more on the upstream side in the sheet conveyance direction than the nip portion, and configured to, when a front end of the sheet member conveyed in the discharge path toward the nip portion abuts the guide portion, guide, toward the first pressing portion, the front end of the sheet member conveyed in the discharge path;

a second stiffening member projecting toward the discharge path from the one of the first conveyance guide member and the second conveyance guide member and extending from the nip portion to the upstream side in the sheet conveyance direction, and configured to stiffen the sheet member by contacting and pressing the sheet member conveyed in the discharge path;

a first elastic member configured to bias the at least one first stiffening member toward the discharge path by an elastic force; and a second elastic member configured to bias the second stiffening member toward the discharge path by an elastic force, wherein the first pressing portion projects farther than the guide portion toward the other of the first conveyance guide member and the second conveyance guide member;

the guide portion is narrower in the width direction than the first pressing portion;

the second stiffening member includes a second pressing portion configured to contact and press the sheet member;

the second pressing portion and the first pressing portion have the same width;

the second stiffening member is disposed at a center in the width direction of the discharge path, and the at least one first stiffening member is disposed at an end in the width direction of the discharge path; and a biasing force of the second elastic member is smaller than a biasing force of the first elastic member.

2. The sheet conveying device according to claim 1, wherein the one of the first conveyance guide member and the second conveyance guide member includes a guide rib which projects from a surface thereof toward the discharge path, and is configured to guide the front end in the sheet conveyance direction of the sheet member conveyed in the discharge path, toward the nip portion, a projection end of the guide rib forms a conveyance guide surface that guides the sheet member inside the discharge path on a side of one of the first discharge roller and the second discharge roller, the guide portion projects farther than the projection end of the guide rib toward the discharge path, and the guide rib projects farther toward the discharge path than an end of the facing surface that is on the upstream side in the sheet conveyance direction, and the facing surface crosses with the conveyance guide surface when viewed from one side in the width direction.

3. The sheet conveying device according to claim 1, wherein the at least one first stiffening member is a plurality of first stiffening members provided along the width direction.

4. The sheet conveying device according to claim 3, wherein one of the first discharge roller and the second discharge roller includes a plurality of roller portions provided along the width direction, and each of the plurality of first stiffening members is disposed between the plurality of roller portions.

5. The sheet conveying device according to claim 1, wherein any one of the first discharge roller and the second discharge roller is a driven roller and the other is a driving roller that is rotated by receiving a rotational driving force and causes the driven roller to rotate by abutting the driven roller.

6. The sheet conveying device according to claim 1, wherein the sheet discharge outlet is formed in a vertical surface of a device main body, the discharge path is formed to extend from a lower position to an upper position in a vertical direction, and then in a curved shape curving toward the sheet discharge outlet, the first conveyance guide member is arranged above the discharge path, and the at least one first stiffening member projects toward the discharge path from the first conveyance guide member.

7. An image forming apparatus comprising the sheet conveying device according to claim 1.

* * * * *